US006257257B1

(12) United States Patent
Shih

(10) Patent No.: US 6,257,257 B1
(45) Date of Patent: Jul. 10, 2001

(54) AUTOMATIC OPENING AND CLOSING STRUCTURE OF A COLLAPSIBLE UMBRELLA

(76) Inventor: Jia-Ling Shih, RM 2C27, Taipei World Trade Center, No. 5, Sec. 5, Hsinyi Rd., Taipei (TW)

( * ) Notice: Subject to any disclaimer, the term of this patent is extended or adjusted under 35 U.S.C. 154(b) by 0 days.

(21) Appl. No.: 09/464,439

(22) Filed: Dec. 16, 1999

(51) Int. Cl.[7] ..... A45B 25/14

(52) U.S. Cl. ..... 135/24; 135/28; 135/25.4; 135/40

(58) Field of Search ..... 135/22, 24, 25.4, 135/28, 37, 38, 40, 41

(56) References Cited

U.S. PATENT DOCUMENTS 5,267,583 * 12/1993 Wu ..... 135/24
5,492,140 * 2/1996 Lin et al. ..... 135/24
5,505,222 * 4/1996 Lin et al. ..... 135/24
5,566,698 * 10/1996 Yu ..... 135/24
5,588,454 * 12/1996 Kou ..... 135/24
5,617,889 * 4/1997 Wu ..... 135/22
5,632,290 * 5/1997 Ling Kuo ..... 135/24
5,868,151 * 2/1999 Kuo ..... 135/24
5,992,433 * 11/1999 Chung-Kuang et al. ..... 135/24

* cited by examiner

*Primary Examiner*—Beth A. Stephan
*Assistant Examiner*—Winnie Yip
(74) *Attorney, Agent, or Firm*—Bacon & Thomas, PLLC

(57) ABSTRACT

This specification discloses an automatic opening and closing structure of a collapsible umbrella that allows the user to open the umbrella to use by pressing a button on the handle so that the runner departs from the hook block on the button and moves toward the notch, which further stretches out the umbrella. When pressing again the button, the sliding block on the button moves to push the connected pin within the handle, which further pushes the hook in the lower tube of the shaft out of the opening on the lower tube for storage. The hook then departs from the bullet head provided in the shaft, and the bullet head slides upward by the pulling of a string. By the spring force of the spring connected on the collapsible rib, the umbrella can be collapsed for storage.

7 Claims, 5 Drawing Sheets

AUTOMATIC OPENING AND CLOSING STRUCTURE OF A COLLAPSIBLE UMBRELLA

BACKGROUND OF THE INVENTION

1. Field of the Invention

The present invention relates to an automatic opening and closing structure of a collapsible umbrella and, more particularly, to an automatic opening and closing structure of a collapsible umbrella that comprises a hook provided inside the lower tube of the shaft, the hook catching to a bullet head within the shaft; a pin and a sliding block provided in the handle so that the button has two sections of pressing.

2. Description of the Prior Art

Umbrellas are indispensable tools in daily lives. Collapsible umbrellas, in particular, are very welcome because the umbrella ribs are collapsible. The umbrella can be collapsed for the convenience of carrying so as to prevent from being caught in the rain. However, current collapsible umbrellas have to be manually collapsed. When the user goes out by car or by bus in a rainy day, he or she has to manually collapse the umbrella before getting on the vehicle. At this moment, the user's clothes are likely to become wet due to the rain. So they are fairly inconvenient.

Therefore, to eliminate the disadvantages by manually collapsing umbrellas, there are umbrellas that can automatically open and close. The main structure is composed of a clasping structure at the bottom of the shaft catching a hook connected with a string in the shaft and a control device within the handle to achieve the object of automatic opening and closing. Nevertheless, the structure is pretty complicated and thus is not easy to fabricate. How to design a structure that simplifies the control device within the handle and the clasping structure in the shaft is the most urgent task.

In view of the many disadvantages described above, conventional items have imperfect designs and need to be improved. The inventor of this patent made great efforts in modification and improvement and, after many years of hard working and research, finally came up with this automatic opening and closing structure of a collapsible umbrella.

SUMMARY OF THE INVENTION

The present invention provides an automatic opening and closing structure of a collapsible umbrella that allows the user to open the umbrella to use by pressing a button on the handle and closing it by pressing again the button for storage.

Furthermore, the present invention provides an automatic opening and closing structure of a collapsible umbrella that does not only have such features as having a simple structure, easy to assemble, and being of highly practical value, but is also applicable to any type of collapsible umbrellas to increase their extra values.

The automatic opening and closing structure of a collapsible umbrella to achieve the above objects comprises a hook on a fixing position within a control tube, said hook being fixed thereby within the control; two openings on the surface of the control tube for the hook to extending out; a shaft for said control tube to be inserted into the lower tube of said shaft; two openings on the surface of the lower shaft corresponding to said two openings on said control tube. When the umbrella is completely closed, the hook catches a bullet head within the shaft, and a runner clasps the hook block on the button. The sliding block connecting to the button moves lower due to the pressing of the runner so that the hollow part thereabove matches one end of a pin within the handle. The other end of the pin is in the lower tube close to the hook in the control tube. When pressing the button on the handle, the runner would depart from the hook block on the button and move toward a notch which further stretches out the umbrella. The pin stays in the hollow part above the sliding block so that it would not be pressed by the pressing of the button. The sliding block that is pressed by the runner is restored back to the original position because of the spring connected therebelow. One end of the pin thus touches the bottom of the sliding block. When the user presses the button on the handle, the block moves and pushes the pin so that the other end of the pin touches the hook in the control tube. The hook is then pushed and extends out of the openings on the surface of the lower tube. The hook is separated from the bullet head and the bullet head moves upward due to the stretch of a string. By the spring in the main rib, the collapsible umbrella ribs are then collapsed to a compact structure.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
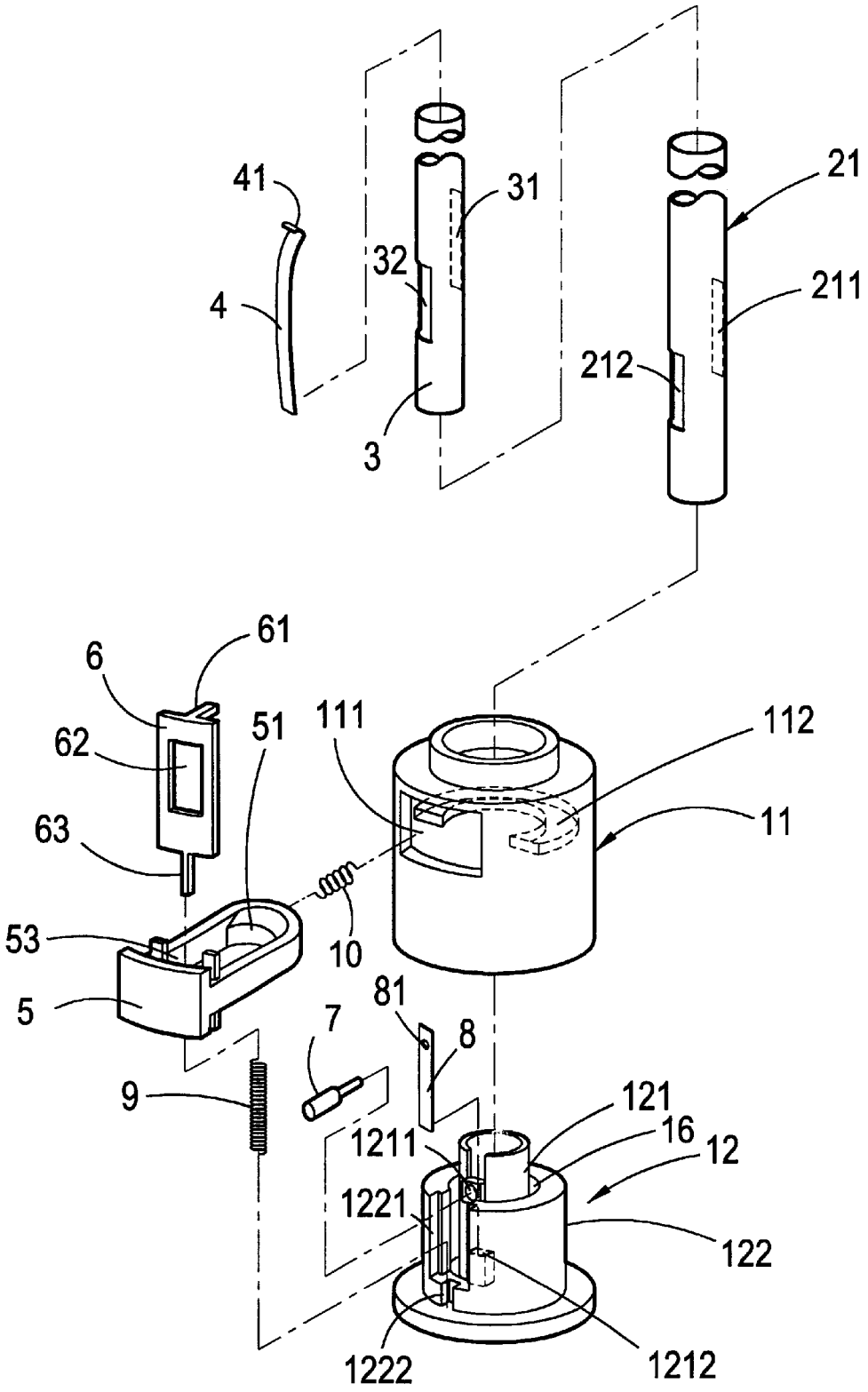
FIG. 1 is a schematic view of the combination of the lower tube and the handle of an automatic opening and closing structure of a collapsible umbrella according to the present invention.
Figure 2:
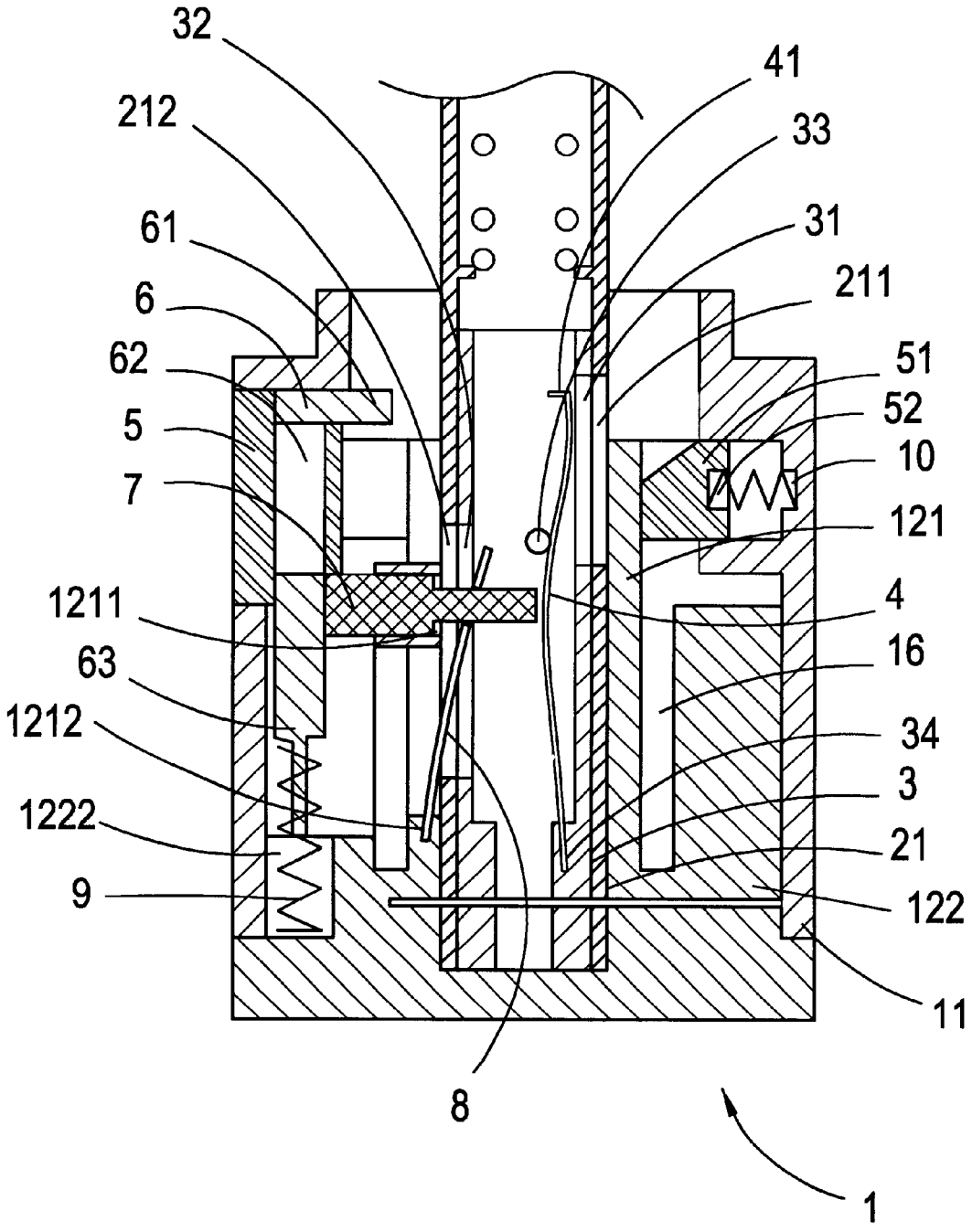
FIG. 2 shows a schematic cross section of the combination of the lower tube and the handle of an automatic opening and closing structure of a collapsible umbrella according to the present invention.

Please refer to FIGS. 1 and 2, which show the automatic opening and closing structure of a collapsible umbrella provided by the present invention. The bottom of a hook 4 is fixed on a base 34 within a control tube 3, and the middle of the hook 4 is disposed at a fixing position 33 within the control tube 3 so that it is positioned to one side of in the control tube 3. The front end of the hook 4 forms a perpendicular angle 41 to achieve the catching function. Two openings 31, 32 are formed on both sides of the control tube 3 surface. The opening 32 corresponds to the middle part of the hook4, and the other opening 31 to the angle 41 on the front of the hook 4. The hook 4 thus can extend out of the control tube 3 via the opening 31. The control tube 3 is inserted into the lower tube of a shaft 2. Two corresponding openings 211, 212 are formed on both sides of the lower tube 21 surface.

A handle 1 comprises a sleeve 11 and a base 12. An opening 11 is formed on one side of the sleeve 11 for the connection of a button 5. The inside of the sleeve opening 111 is provided with a sliding track 112 so that the button 5 can slide in the sleeve 11. The front of the button 5 is provided with a book block 51, which is formed with a groove 52 at the front end for the connection to a spring 10. The button can then restore its original position with the help of the spring 10 while being pressed. A sliding track 53 is provided on both sides of the button 5 for a sliding block 6 to slide thereon. The middle part of the sliding block 6 has to hollow structure 62, the top end is extended with a block 61, and the bottom is extended with a pillar 63 for a spring 9. The base 12 is formed with a connection part 121. One side of the connection part 121 is provided with a slit 1212 and a through hole 1211 is formed at a proper position thereon. When the lower tube 21 of the shaft 2 is connected with the handle 1 through the connection part 121, the opening 212 thereon would match with the through hole 1211 on the connection part 121. A spring plate 8 is provided in the slit 1212, and an aperture 81 formed on the top of the spring 8 matches the through hole 1211 on the connection part 121 so that a pin 7 can be inserted via the through hole 1211, the aperture 81 on the top of the spring plate 8, and the opening 212 on the lower tube 21 into the control tube 3 and gets close to the hook 4. A sleeve 122 surrounds the connection part 121 to form a compartment 16 for the storage of a runner 13 when the umbrella is collapsed. A compartment groove 1221 is formed at the corresponding position on both the sleeve 122 and the connection part 121 for the sliding block 6 to slide therein. The lower end of the compartment groove 1221 is formed with a groove 1222. When the base is inserted into the sleeve 11, the spring 9 connecting to the bottom of the sliding block 6 would falls into the groove 1222. One end of the pin 7 touches the bottom of the sliding block 6. The above structure forms the control device of the umbrella.

Figure 3:
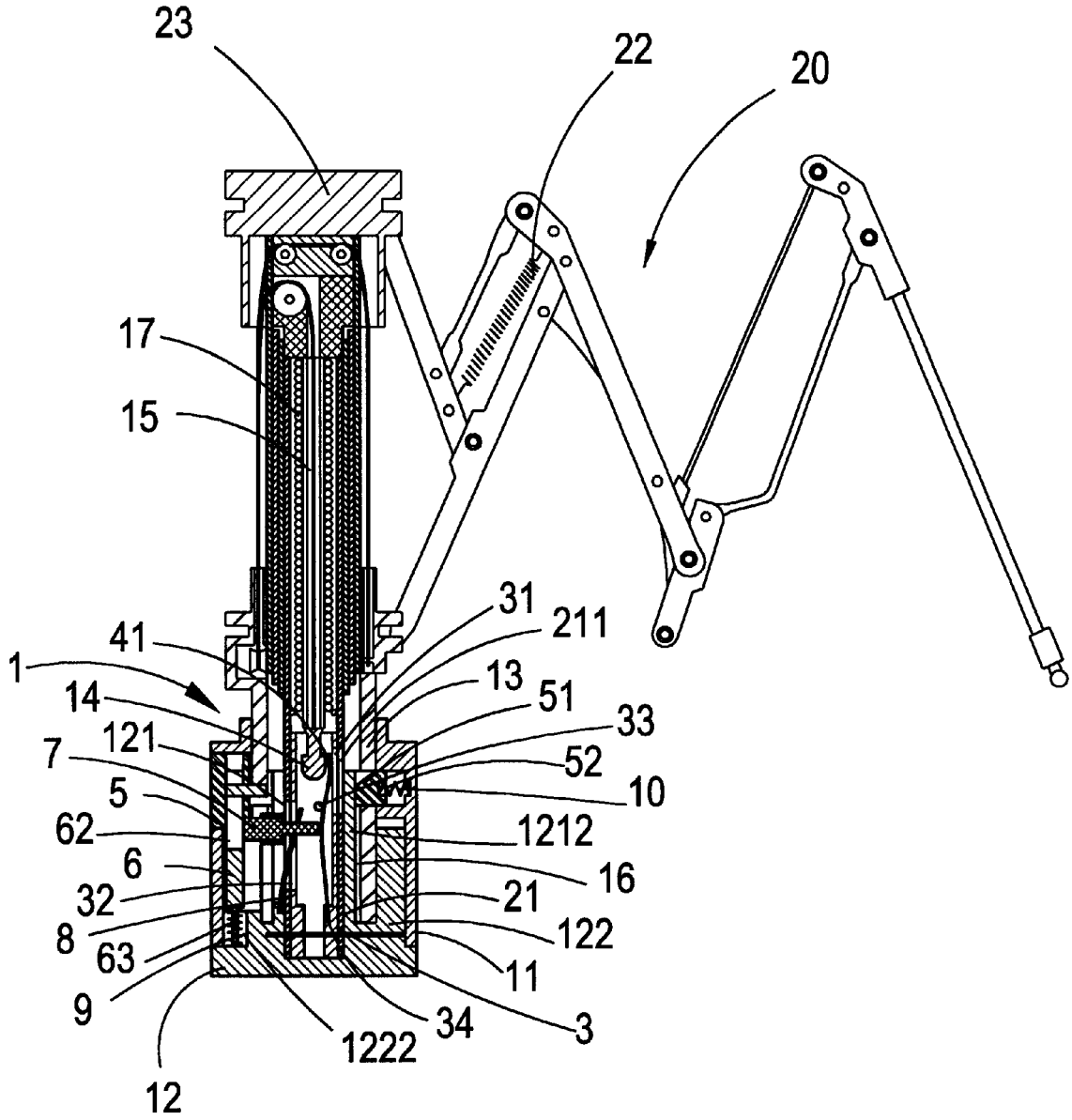
FIG. 3 is a schematic view of a completely collapsed umbrella with an automatic opening and closing structure according to the present invention.

Please refer to FIG. 3, which is a schematic view of a completely collapsed umbrella with an automatic opening and closing structure according to the present invention. When the umbrella is completely collapsed, a hook hole 131 on the runner would catch the hook block 51 on the button 5 so that the runner 13 is disposed within the compartment space 16 formed by the connection part 121 and the sleeve 122. The hook 4 within the control tube 3 can catch the bullet head in the shaft.

The sliding block 6 connecting to the button 5 would be pushed on the extended block 61 by the runner 13 when collapsing and slide downward into the compartment groove 1211 on the sleeve 122. The spring 9 on the bottom of the sliding block 6 is then squeezed into the groove 1222 at the bottom of the sleeve compartment groove 1221. The pin 7 moves to the hollow part 62 of the sliding block 6 due to the motion of the sliding block 6.

Figure 4:
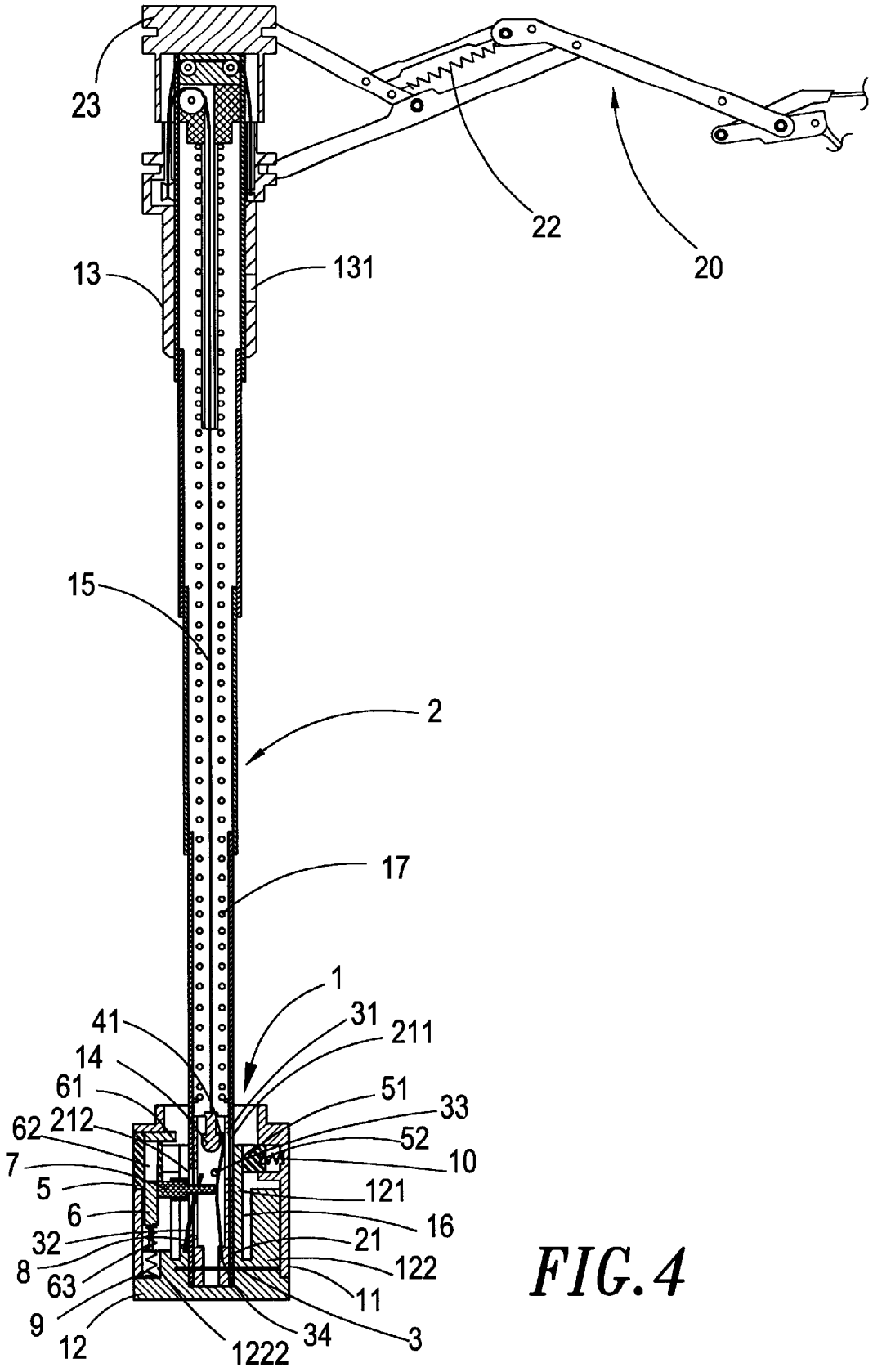
FIG. 4 is a schematic view of automatic opening of the umbrella with an automatic opening and closing structure according to the present invention.

Please refer to FIG. 4, which is a schematic view of automatic opening of the umbrella with an automatic opening and closing structure according to the present invention. When the button 5 on the handle 1 is pressed, the sliding block 6 would move so that the pin 7 would be disposed in the hollow part 62 of the sliding block 6 due to the motion of the sliding block 6. The runner 13 would depart from the hook block 51 at the front of the button 5 and move toward a notch 23. By a spring 17 in the shaft, the umbrella would be fully stretched out so that a spring 22 on the collapsible rib 20 is stretched. The button 5 on the handle 1 would restore its original position due to the spring 10 connecting to its front end. The block 6 would also move upward due to spring 9 at the bottom after the restoration of the button 5 and the departure of the runner 13. Therefore, one end of the pin 7 touches the bottom of the sliding block 6.

Figure 5:
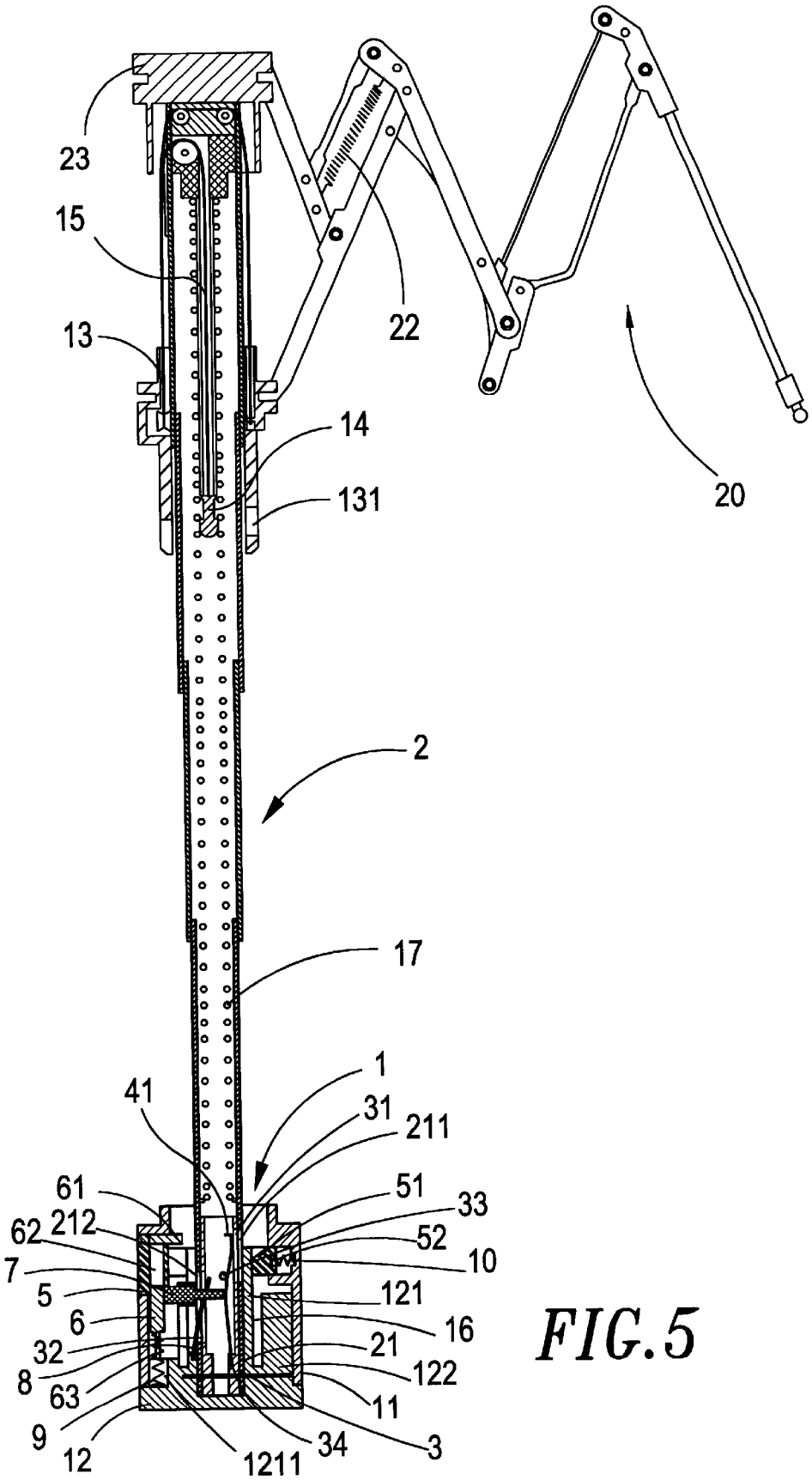
FIG. 5 is a schematic view of automatic closing of the umbrella with an automatic opening and closing structure according to the present invention.

Please refer to FIG. 5, which is a schematic view of automatic closing of the umbrella with an automatic opening and closing structure according to the present invention. When the button 5 on the handle 1 is pressed again, the sliding block 6 would move. Since the pin touches the bottom of the sliding block 6, it would be pushed by the sliding block 6 so that the other end touches the hook 4 in the control tube 3 and further pushes the hook 4. The angle 41 at the front end of the hook 4 is pushed out of the opening 211 on the lower tube 21 so that the hook 4 departs from the bullet head 14 within the shaft 2. The bullet head 14 then moves upward by the pulling of the string 15, and the runner moves downward slightly. This causes the contraction of the spring 22 connecting on the umbrella rib 20, which further collapses the rib 20. The pin 7 restores its original position due to the spring plate 8, and the hook 4 also restores its original position because of the influence of the fixing position 33 within the control tube 3. Therefore, the control device formed by the combination of the hook 4 in the lower tube 21 of the shaft 2 and the handle 1 provides two sections of pressing on the button 5 so that the umbrella can automatically open and close.

Compared with the prior art, the automatic opening and closing structure of a collapsible umbrella has the following advantages:

1. A control tube is provided within the lower tube for connecting a hook at the fixing position so that the hook can catch a bullet head within the shaft. With the design of the button, the sliding block, the pin, the spring, and the spring plate, the button has two sections of pressing to achieve the goal of automatic opening and closing.
2. The present invention does not only have the features of a simple structure, easy to assemble, and highly practical value, it also applies to any type of umbrellas which increases its extra value.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic opening and closing structure of a collapsible umbrella, which comprises:

a lower tube of a shaft, which has openings on the lower surface;

a runner slidably mounted on said shaft, said runner having an opening and a lower end;

a control tube, which is inserted within said lower tube, provided with a fixing position, and formed with openings corresponding to said openings on said lower tube;

a hook, the bottom of which is fixed on a base in said control tube and the middle of which is fixed at said fixing position within said control tube;

a sleeve, which is formed with an opening on the top and a sliding track is provided therein;

a base, which is provided with a connection part for the connection of said lower tube of said shaft, said connection part being formed with a slit, said slit being formed with a through hole, and said through hole being corresponding to one opening on said lower tube, a base sleeve surrounding said connection part and being provided with a compartment groove, said compartment groove being formed with a groove at the bottom at said base sleeve;

a button, which is connected within the opening of said sleeve and provided with a sliding track, the front end of which is provided with a hook block, which block is formed with a groove in the front being engaged with a spring and corresponding to said opening of said runner so that it would restore its original position when being pressed;

a sliding block, which is connected on said sliding track of said button for sliding, said sliding block being extended with a block in the front end being corresponding to said lower end of said runner having a hollow structure in the middle, and being extended with a pillar at the bottom being connected with a lower spring;

a spring plate, which is connected to a groove on said connection part, said spring plate being formed with an aperture corresponding to said through hole on said connection part; and a pin, one end of which is inserted via said through hole of said connection part and said aperture at the top of said spring plate into said opening of said control tube;

wherein when said base and said sleeve are connected, said lower spring connecting to the bottom of said sliding block is disposed within said groove at the bottom of said sleeve compartment groove, and one end of said pin would touch the bottom of said sliding block to form a control device for an automatic opening and closing umbrella.

2. The automatic opening and closing structure of a collapsible umbrella of claim 1, wherein the top of said hook forms a perpendicular angle so that a bullet head within the shaft can be caught thereby.

3. The automatic opening and closing structure of a collapsible umbrella of claim 1, wherein said connection part and said surrounding sleeve form a compartment space for the disposal of said runner when the umbrella is collapsed.

4. The automatic opening and closing structure of a collapsible umbrella of claim 1, wherein when said pin is pushed by said sliding block it can be restored by the spring force of said spring plate connected to said connection part slit.

5. The automatic opening and closing structure of a collapsible umbrella of claim 1, wherein said button can slide within the sleeve through said sliding track in said sleeve opening, and said hook block provided in the front hooks to said runner.

6. The automatic opening and closing structure of a collapsible umbrella of claim 1, wherein said sleeve and said base combine to form the handle.

7. The automatic opening and closing structure of a collapsible umbrella of claim 1, wherein when said sliding block is pushed by said runner, said sliding block is disposed within said compartment groove on said base sleeve, whereas said lower spring at the bottom is squeezed into said groove at the bottom of said compartment groove, and said sliding block can restore its original position when said runner departs.

* * * * *